US005795142A

United States Patent [19]

Merz et al.

[11] Patent Number: 5,795,142

[45] Date of Patent: Aug. 18, 1998

[54] HYDRAULICALLY BALANCED VANE CELL PUMP

[75] Inventors: Johann Merz, Schwäbisch Gmünd, Germany; Masao Yasuda, Yokohama, Japan

[73] Assignee: ZF Friedrichshafen AG., Friedrichshafen, Germany

[21] Appl. No.: 785,134

[22] Filed: Jan. 13, 1997

[30] Foreign Application Priority Data

Jan. 11, 1996 [DE] Germany ..... 196 00 740.2

[51] Int. Cl.[6] ..... F04C 15/00

[52] U.S. Cl. ..... 418/133; 418/259

[58] Field of Search ..... 418/133, 259; 417/410.3, 220

[56] References Cited

U.S. PATENT DOCUMENTS 2,766,700 10/1956 Klessig ..... 418/133

4,408,964 10/1983 Mochizuki et al. ..... 417/310

5,112,199 5/1992 Otaki et al. ..... 417/310

FOREIGN PATENT DOCUMENTS 485177 7/1952 Canada ..... 418/133

*Primary Examiner*—Timothy Thorpe

*Assistant Examiner*—Peter G. Korytnyk

*Attorney, Agent, or Firm*—Larson & Taylor

[57] ABSTRACT

The invention relates to a vane cell pump with a control plate (8) and an end plate (6), between which a pump package (1) is located. The control plate (8) and the end plate (6) have suction and compression chambers (12, 12A and 13, 13A, respectively) opposite one another. While the control plate (8) controls the inflow and outflow of oil, the end plate (6) has a function of guiding the oil. According to the invention, the control edges (15, 15A, 16, 16A, 17, 17A, 18, 18A) on the end plate (6) are recessed relative to the control edges of the control plate (8). This provision enables more-economical manufacture.

1 Claim, 2 Drawing Sheets

HYDRAULICALLY BALANCED VANE CELL PUMP

BACKGROUND OF THE INVENTION

1. Field of the Invention

The invention relates to a vane cell pump, having a housing that includes a control plate and an end plate, which between them enclose a rotor with slits, fixed to a shaft, and a cam ring. Radially displaceable vanes are guided in the slits of the rotor and are pressed outward into the cam ring. The cam ring and the control plate and end plate are retained in the housing by means of pins. The suction and compression chambers, which face one another, are machined into the faces of the control and the end plates which face one another.

2. Description of the Prior Art

A vane cell pump of this kind is known for instance from DE 41 12 196 A1, with a separate control plate (pressure plate 6) and an end plate (5) that is integral with the housing. The control edges of the suction and compression chambers must normally be precisely opposite one another, because on the one hand they control the oil stream and on the other hand they form axial pressure fields that hydraulically center the rotor and vanes. The guidance and securing of the control plate and the fixation of the cam ring are effected by pins that are flush with the housing.

A pump is also known (U.S. Pat. No. 5,112,199) in which the control plate and end plate are separate, and the control plate is precisely guided on the housing side with pins, while the end plate on the other side of the cam ring has unavoidable play. However, this pin-hole play of the end plate affects the control angles. When the tolerances are added together, the coincidence between the suction and compression chambers decreases.

The object of the invention is to manufacture a pump wherein the flow of fluid is controlled economically by a control surface located in a single control plate, such as a vane cell pump.

SUMMARY OF THE INVENTION

This object can be attained by the vane cell pump of the invention, in that the control edges, formed with the suction and compression chambers, in the end plate are recessed relative to the control edges of the suction and compression chambers in the control plate.

Because of the recessing of the control edges on the end plate, only one side controls the oil flow, namely the control plate. The original control edges in the end plate have no control function over the oil with respect to the control angle. This has no influence whatever on the function, since the suction and compression chambers are needed solely for hydraulic axial force equalization and for oil guidance.

The invention is described in further detail below in terms of an exemplary embodiment shown in the drawing.

DETAILED DESCRIPTION OF THE PREFERRED EMBODIMENT

Figure 1:
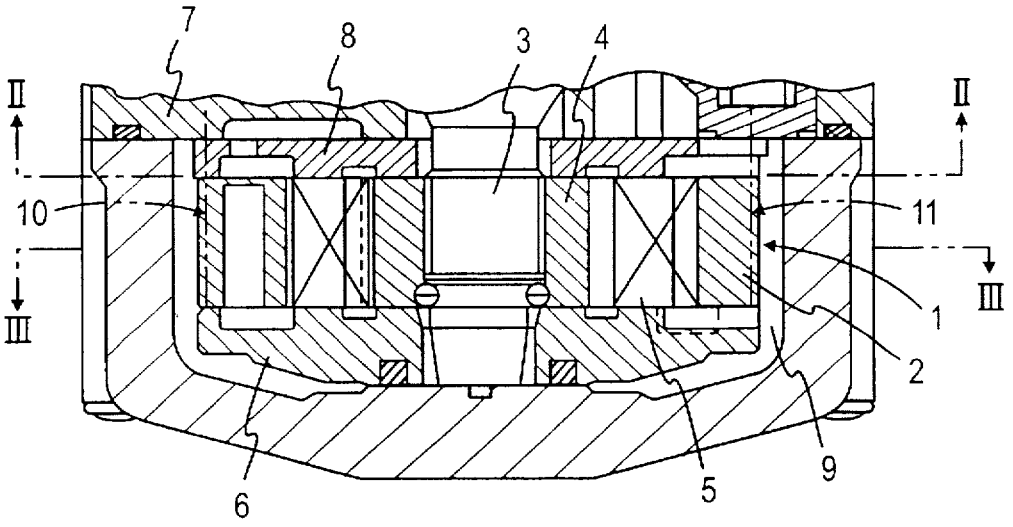
FIG. 1, a fragmentary cross section through the pump package.

The pump package 1, in a known manner, comprises a cam ring 2 and a rotor 4, driven by a shaft 3 and having slits in which the vanes 5 are mounted. The vanes 5 are pressed against the cam ring 2. On one side of the pump package 1 is an end plate 6, and on the side pump package 1 facing toward a housing 7, there is a control plate 8. The end plate 6 and the control plate 8 are fixed accurately relative to the housing 7 by pins 10, 11 (shown by dot-dashed lines). A pump pressure chamber 9 communicates with the pump outlet.

Figure 2:
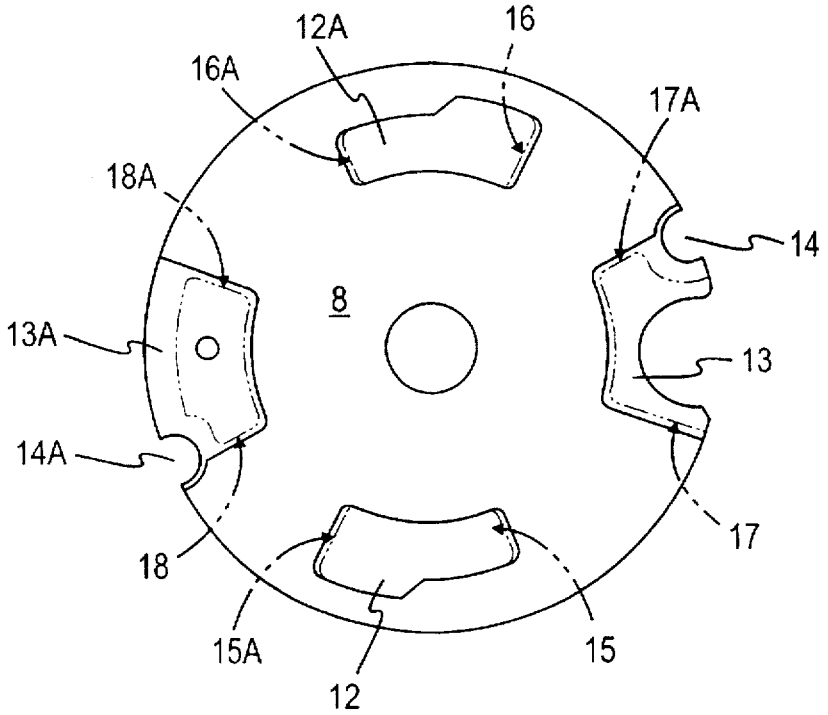
FIG. 2, an elevation view of the control plate with the contours of suction and compression chambers in the end plate behind it suggested in dashed lines.
Figure 3:
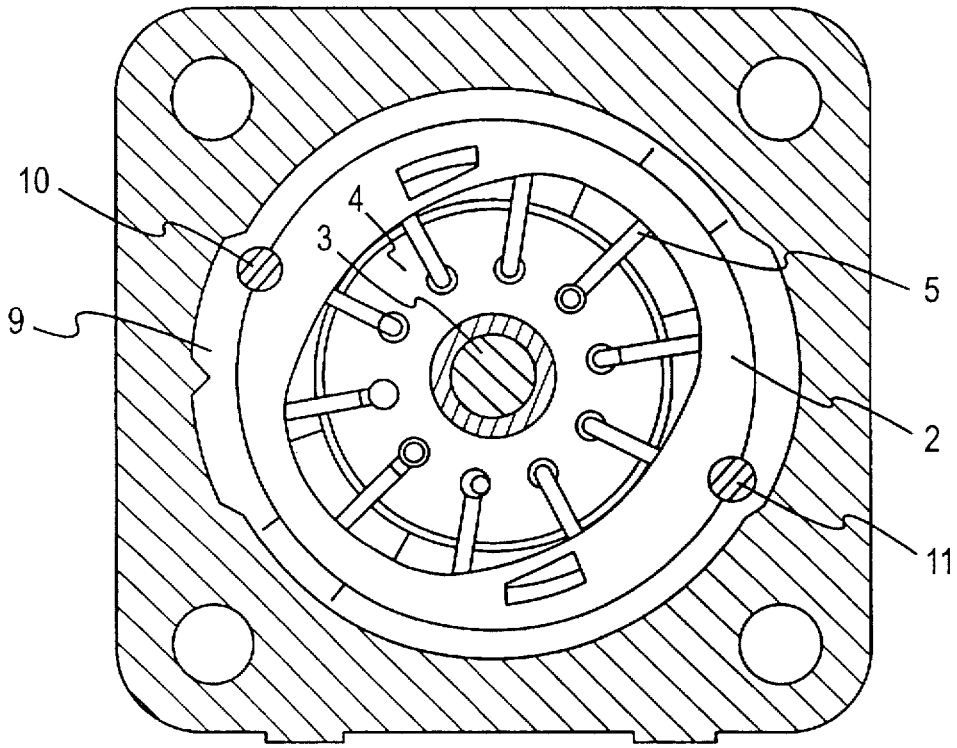
FIG. 3, an elevation view of the rotor along the lines III—III of FIG. 1.

In FIG. 2, suction chambers 12 and 12A and compression chambers 13 and 13A can be seen in the control plate 8 of a double-stroke pump. Via the suction chambers 12 and 12A, the oil passes from a tank into the pump, and the compression chambers 13 and 13A communicate with the pump outlet on the compression side. The control plate 8 determines the opening angles. The suction and compression chambers in the end plate 6, in the same position on the other side of the pump package 1, form so-called pressure fields and provide hydraulic force equalization of the rotor 4 and vanes 5. More specifically, the suction chambers 12 and 12A contain a low suction pressure while the pressure chambers 14 and 14A contain a high pressure. The radially outward end walls of the suction chambers and the pressure chambers define the control edges which control the flow of suction oil into the pump and the flow of high pressure oil to the outlet port of the pump. The impingement of the oil at various pressures on the suction and pressure chambers exerts hydraulic loads or forces onto the control plate. These hydraulic loads or forces can be balanced and equalized by providing suction and pressure chambers also in the end plate 6 on the opposite side of the rotor 4 since pressure fields or pressure areas formed in the suction chambers and pressure chambers in the end plate 6 will also exert hydraulic loads or forces on the end plate 6 thereby balancing the hydraulic loads or forces on the control plate 8. These hydraulic forces will cancel out thereby providing hydraulic force equalization. The pins 10 and 11 extend through half bores 14 and 14A.

According to the invention, control edges 15, 15A, 16, 16A, 17, 17A and 18, 18A on the compression and suction chambers of the end plate 6 are recessed relative to the control edges of the control plate 8. The regions of coincidence of the suction and compression chambers 12, 12A, 13, 13A thus become smaller. This offset of the control edges on the end plate 6 does not affect the control angles at the suction and compression chambers of the control plate 8. Nor does the play of the pin-holes affect the control angles.

What is claimed is:

1. A vane cell pump comprising:

a housing, a control plate and an end plate located in the housing;

a rotor fixed to a shaft and having slits and a cam ring, both of which are enclosed by the control and end plates;

radially displaceable vanes guided in the slits of the rotor;

the cam ring, the control plate and end plate are retained in the housing by means of pins;

a suction chamber and a compression chamber machined into the face of the control plate and a suction chamber and a compression chamber machined into the face of the end plate which is in opposing relationship to the face of the control plate which includes the suction chamber and the compression chamber, each suction and compression chamber being provided with control edges, and wherein the control edges of the suction and compression chambers in the end plates are recessed inwardly relative to the control edges of the suction and compression chambers in the control plate whereby the control edges of the control plate perform the control function of controlling flow of oil in the pump.

* * * * *

UNITED STATES PATENT AND TRADEMARK OFFICE

CERTIFICATE OF CORRECTION

PATENT NO. : 5,795,142

DATED : August 18, 1998

INVENTOR(S) : Merz et al.

It is certified that error appears in the above-indentified patent and that said Letters Patent is hereby corrected as shown below:

Title page: item [73], after "Friedrichshafen, Germany" insert

--and Unisia Jecs Corporation, Kanagawa-Ken, Japan--

Signed and Sealed this

Sixteenth Day of February, 1999

*Attest:*

*Attesting Officer*

*Acting Commissioner of Patents and Trademarks*